US006719304B2

(12) United States Patent
Miller et al.

(10) Patent No.: US 6,719,304 B2
(45) Date of Patent: Apr. 13, 2004

(54) ROLLER SKATE

(76) Inventors: Robbie L. Miller, 111 Sprucedale Dr., Duncansville, PA (US) 16635; Joel Luing, 6980 Aragon Cir., #8, Buena Park, CA (US) 90620

( * ) Notice: Subject to any disclaimer, the term of this patent is extended or adjusted under 35 U.S.C. 154(b) by 46 days.

(21) Appl. No.: 10/037,792

(22) Filed: Jan. 2, 2002

(65) Prior Publication Data

US 2002/0105153 A1 Aug. 8, 2002

Related U.S. Application Data

(63) Continuation-in-part of application No. 09/776,848, filed on Feb. 6, 2001, now abandoned.

(51) Int. Cl.[7] ..... A63C 17/02
(52) U.S. Cl. ..... 280/11.27; 280/11.3; 280/11.209
(58) Field of Search ..... 280/11.19, 842, 280/11.209, 11.27, 11.3, 11.36, 11.28, 11.31

(56) References Cited

U.S. PATENT DOCUMENTS 96,117 A * 10/1869 Hubbard ..... 280/11.19
106,725 A * 8/1870 Platt ..... 280/11.3
153,945 A * 8/1874 Gregg ..... 280/11.19
2,430,037 A * 11/1947 Vincent ..... 280/11.209
2,719,723 A * 10/1955 Ware ..... 280/11.209
3,112,119 A * 11/1963 Sweet ..... 280/11.209
4,394,028 A * 7/1983 Wheelwright ..... 280/11.19
4,709,937 A * 12/1987 Lin et al. ..... 280/11.209

FOREIGN PATENT DOCUMENTS

JP 5-146538 * 6/1993 ..... A63C/17/02

* cited by examiner

*Primary Examiner*—Avraham Lerner
(74) *Attorney, Agent, or Firm*—Raymond Y. Chan; David and Raymond Patent Group

(57) ABSTRACT

A roller skate has a frame formed of a short length of sturdy, generally rectangular channel material having two opposed side walls and a sole plate or floor extending therebetween. A large diameter wheel is secured to each end of each side wall, to define a widely spaced rectangular wheel array providing a stable skate platform. The high attachment of the large diameter wheels places the sole plate immediately adjacent the underlying surface when the wheels are resting on that surface, for greater stability. Instep and heel straps extended from single central attachment points along each side wall, with the present skate being essentially longitudinally and laterally symmetrical. Provision may be made for vertical and/or lateral adjustment of the wheels relative to the skate frame, if so desired.

32 Claims, 5 Drawing Sheets

ROLLER SKATE

CROSS REFERENCE OF RELATED APPLICATION

This is a Continuation-In-Part application of a non-provisional application having an application of 09/776,848 and a filing date of Feb. 06, 2001, now abandoned.

BACKGROUND OF THE PRESENT INVENTION

1. Field of Invention

The present invention relates generally to wheeled skates, and more particularly to a roller skate having a chassis or frame formed of a length of rectangular channel. The four relatively large diameter wheels extend from the upper walls of the channel, thereby placing the floor or sole plate of the frame very close to the underlying surface for optimum stability.

2. Description of Related Arts

The basic concept of the roller skate, with relatively small diameter wheels disposed beneath a sole plate for attachment to or carrying a shoe thereon, has been known for some time. While this basic configuration has been popular for recreation, sports, and even limited transportation, it has its deficiencies. The greatest deficiency of this conventional type of skate is the relatively high center of gravity and narrow wheel track provided by placing the wheels directly beneath the sole plate of the skate, emulating the earlier developed ice skate with its narrow blade and shoe structure atop the blade.

Accordingly, a number of variations on the conventional roller skate have been developed over the years, with many of these variations having the wheels extending to the sides of the skate body rather than beneath the body or sole plate. The primary reason for this construction by earlier patentees, was to provide relatively large diameter wheels for operation on relatively rough and unimproved surfaces, as was the norm until relatively recent times. As such, those earlier skates were constructed with various wheel configurations, but no such large wheeled earlier skates utilized a four wheel configuration, with the wheels deployed in a rectangular array at the corners of the skate body for stability. Rather, those earlier large wheeled skates teach away from the concept of stability, by providing three wheeled configurations, and/or wheels having different diameters from one another, etc., for various purposes.

Accordingly, a need will be seen for a roller skate formed of a relatively short, sturdy length of channel, having a width sufficiently wide for the skater to place his or her shoe therein. The upstanding side walls of the channel provide for the attachment of axle extending therefrom, for the placement of a wheel adjacent each corner of the generally rectangular channel section. The walls are sufficiently high to allow installation of relatively large diameter wheels, while still placing the floor of the channel relatively close to the underlying surface. Means are also provided for vertical and lateral adjustment of the wheels on the skate body.

A discussion of the related art of which the present inventor is aware, and its differences and distinctions from the present invention, is provided below.

U.S. Pat. No. 96,117 issued on Oct. 26, 1869 to N. W. Hubbard, titled "Parlor Skate," describes a wheeled skate having a sole plate with three arms extending laterally upwardly therefrom. Each arm has an axle at its upper end, with a large diameter wheel mounted thereon. The result places the sole plate relatively close to the underlying surface. However, Hubbard provides only one wheel on the inboard side, with the opposite two wheels not being in alignment with one another due to their overlapping diameters. The point of the Hubbard skate is clearly operation over rough surfaces, as indicated in column 2, lines 9–13 of the disclosure. The result is neither as sturdy nor as stable as the present skate.

U.S. Pat. No. 233,845 issued on Nov. 2, 1880 to Washington P. Gregg, titled "Roller Skate," describes a skate with a rhomboid wheel pattern, with smaller diameter wheels placed beneath the forward and aft ends of the sole plate or frame and two different diameters of larger wheels extending to the sides of the frame. The larger wheels of the Gregg skate provide more even movement over rough and uneven surfaces, while the smaller wheels provide additional support. However, the smaller wheels disposed beneath the frame or sole, still result in a considerably higher sole plate than that of the present skate. Moreover, the rhomboid wheel pattern does not provide the stability of the present skate, with one wheel disposed generally at each corner of the frame.

U.S. Pat. No. 266,978 issued on Nov. 7, 1882 to Norman W. Darrow, titled "Wheel Skate," describes a two wheeled skate, with the two wheels generally disposed diagonally to one another. The sole plate or frame is suspended between the wheels to move vertically as the skater removes and applies his or her weight to the skate. A system of gears, chains, and ratchets is provided between each wheel and the frame, for driving the wheels in a forward direction as weight is applied to the frame by the skater and the frame is driven downwardly; the arrangement ratchets to allow the wheels to rotate freely upon upward movement of the frame. The Darrow skate is more closely related to an operator propelled machine than to a skate, and in any event, the lack of wheels at each corner of the frame and the vertically movable frame relative to the wheels, both teach away frame the present skate.

U.S. Pat. No. 1,751,942 issued on Mar. 25, 1930 to Robert Nanz, titled "Roller Skate," describes a two wheeled skate having the wheels disposed generally diagonally from one another on opposite sides of the skate. Each wheel is secured to the upper end of an arm which extends laterally upwardly from the base platform or sole plate of the skate, somewhat in the manner of the skate of the Hubbard '117 U.S. Patent discussed further above. The use of separate arms for attaching the wheels and provision of only a single wheel on each side and the lack of stability provided thereby, result in a skate configuration considerably different from that of the present roller skate invention and having considerably less stability.

U.S. Pat. No. 3,476,399 issued on Nov. 4, 1969 to Lawrence A. Finn, titled "Skates," describes two different embodiments of a two wheeled skate, with the wheels disposed laterally oppositely to one another. The second embodiment has relatively large diameter wheels installed on vertically offset axle stubs, with the center of the axle bent downwardly to pass beneath the relatively short (fore and aft) sole plate. Separate instep and heel straps are provided, but the Finn skate is rendered relatively more complex by having two separate attachment points on each side of the skate. The provision of only two wheels clearly fails to provide the stability provided by the present skate, with its four wheels disposed generally at the corners of a channel structure having a rectangular platform.

U.S. Pat. No. 5,165,708 issued on Nov. 24, 1992 to Chan I-Chuan, titled "Double-Foot Plate Pedaling Skate,"

describes an operator propelled device comprising essentially two jointed skates with two sole plates and six wheels. Two wheels are installed between the two plates, with the two plates eccentrically linked together by the two center wheels. The other four wheels are attached to the outboard edges of the two plates on eccentrics similar to the center eccentrics, with each plate being level but 180 degrees opposed to the other relative to wheel rotation, due to the eccentric connection. The operator pumps the two plates upwardly and downwardly to produce rotary motion due to the eccentric action. The relative motion of the two sole plates is unlike the relatively constant level plates of the present skate.

U.S. Pat. No. 6,065,763 issued on May 23, 2000 to Raymond L. Adams Jr., titled "Roller Bouncer And Wave Board Skate," describes a skate having a somewhat conventional wheel configuration, with four relatively small diameter wheels disposed beneath a lower plate. However, an upper shoe attachment plate is disposed above the lower wheel attachment plate, with a series of springs installed therebetween. While the Adams, Jr. skate may provide an interesting recreational ride, the height of the device with its closely adjacent lower wheels and springs separating the wheel platform from the shoe support platform, result in a relatively unstable device in comparison to the present roller skate.

British Patent Publication No. 221,445 accepted on Sep. 11, 1924, titled "Improvements In And Connected With Wheeled Skates," describes a three wheeled skate having two relatively large laterally disposed wheels at the front and a single large diameter wheel laterally offset to the rear. As the only drawings illustrating the wheels with the skate body are plan view, it is not possible to determine the relative height of the wheel axles relative to the skate body or sole plate. However, it would appear that no effort has been made in the British Patent Publication to provide a relatively low sole plate. The combination of a relatively high sole plate or skate body or frame, with the tricycle configuration, results in considerably less stability than provided by the present roller skate invention.

British Patent Publication No. 403,250 accepted on Dec. 21, 1933, titled "Improvements In Roller Skates," describes several embodiment of three and four wheeled skates. Each of the four wheeled embodiments positions the wheel axles either below or coplanar with the sole plate or frame of the skates, rather than above the plate as in the present invention. While the '250 British Patent Publication does disclose embodiments with some of the wheel axles above the sole plate, these are all three wheeled skates with a single relatively small diameter rear wheel extending rearwardly from the sole plate or frame. The lack of stability provided by a tricycle configuration has been noted further above.

Finally, British Patent Publication No. 1,318,039 published on May 23, 1973, titled "Roller Skates," describes a skate having a relatively conventional configuration, with four relatively small diameter wheels disposed directly beneath the front and rear portions of the sole plate or frame. The primary distinction of the skate of the '039 British Patent Publication appears to be the forming of a relatively thick support structure integrally with the sole plate, and the use of rubber or plastic material for the support structure and sole plate. The lack of stability of the relatively narrow wheel configuration of the skate of the '039 British Patent Publication, has been noted further above.

None of the above inventions and patents, taken either singly or in combination, is seen to describe the instant invention as claimed.

SUMMARY OF THE PRESENT INVENTION

The present invention comprises a roller skate having various novel features providing increased stability and safety over earlier developed skates of the related art. The present skate is formed essentially of a relatively short length of a sturdy, generally rectangular channel having opposed upstanding side walls and a sole plate or floor extending therebetween. A non-skid coating or sheet is disposed upon the sole plate to provide good grip for the shoe sole of the skater. A relatively large diameter wheel is placed at each end of each side wall to form a rectangular wheel array, with the wheels extending beyond the side walls and ends of the frame for optimum stability. Instep and heel straps extend from attachment points generally medially placed along the upper edge of each side wall.

The relatively deep side walls, in combination with the large diameter wheels, place the sole plate of the frame immediately adjacent the underlying surface when the wheels are resting upon the underlying surface. This provides even further stability for the present skate. The wheels may be adjustably secured to the frame side walls if desired, by providing a series of axle attachment holes at varying heights through the side walls at each wheel location. Adjustment of the lateral spacing of the wheels may be provided by installing sleeves, spacer nuts, etc. on each wheel axis between the wheels and the frame side walls, as desired. This allows the skater to place the wheels even further outwardly from the side walls, for even greater stability if so desired.

Accordingly, it is a principal object of the invention to provide a roller skate having greater stability than wheeled skates of the related art.

It is another object of the invention to provide a roller skate having four widely spaced large diameter wheels disposed at the corners of the skate frame in a rectangular array, to provide a stable skate platform.

It is a further object of the invention to form the skate frame of a short, sturdy length of channel having a floor or sole plate with opposed upstanding walls, with the wheels extending outwardly from the walls so the sole plate is positioned immediately adjacent the underlying surface for greater stability.

Another object of the present invention is to provide a roller skate which comprises a brake device for reducing a speed of the roller skate, wherein the roller skate does not require to alter the original structural design in order to incorporate with the brake device, so as to minimize the manufacturing cost of the roller skate.

Still another object of the invention is to provide a roller skate including means for adjusting the wheels both vertically and laterally relative to the skate frame.

It is an object of the invention to provide improved elements and arrangement thereof in an apparatus for the purpose described which is inexpensive, dependable and fully effective in accomplishing its intended purposes.

Another object of the present invention is to provide a roller skate, wherein no expensive or mechanical structure is required to employ in the present invention in order to achieve the above mentioned objects. Therefore, the present invention successfully provides an economic and efficient solution for providing substantial supporting configuration to the skater supported on the roller skate.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
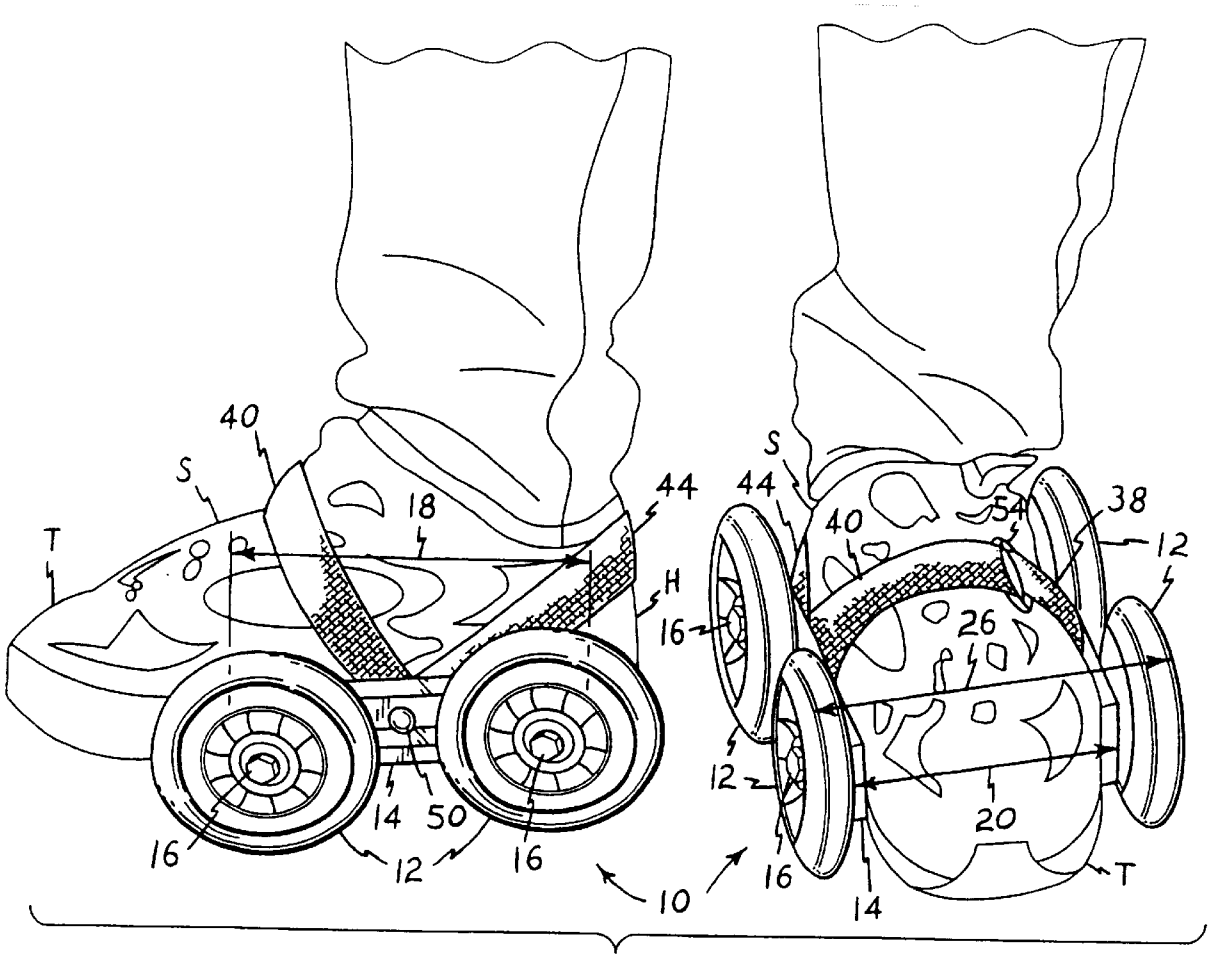
FIG. 1 is an environmental perspective view of a pair of the present roller skates being worn, showing their general features.

The present invention comprises a roller skate having a novel structure providing much improved stability over conventional skates of the related art. FIG. 1 provides an environmental perspective view illustrating a pair of the present skates 10 in use. The present skate 10 has a width sufficient to place the wheels 12 to the outside of the central frame 14 which cradles the skater's shoe S, thus allowing the sole plate of the frame 14 to be dropped beneath the plane of the wheel axles 16 to reside immediately adjacent to the underlying surface when the wheels 12 are resting thereon, generally as shown in FIG. 1 of the drawings. The wheel axles 16 extend from the forward and rearward ends of the frame 14, thus providing a relatively long wheelbase for additional stability.

Figure 2:
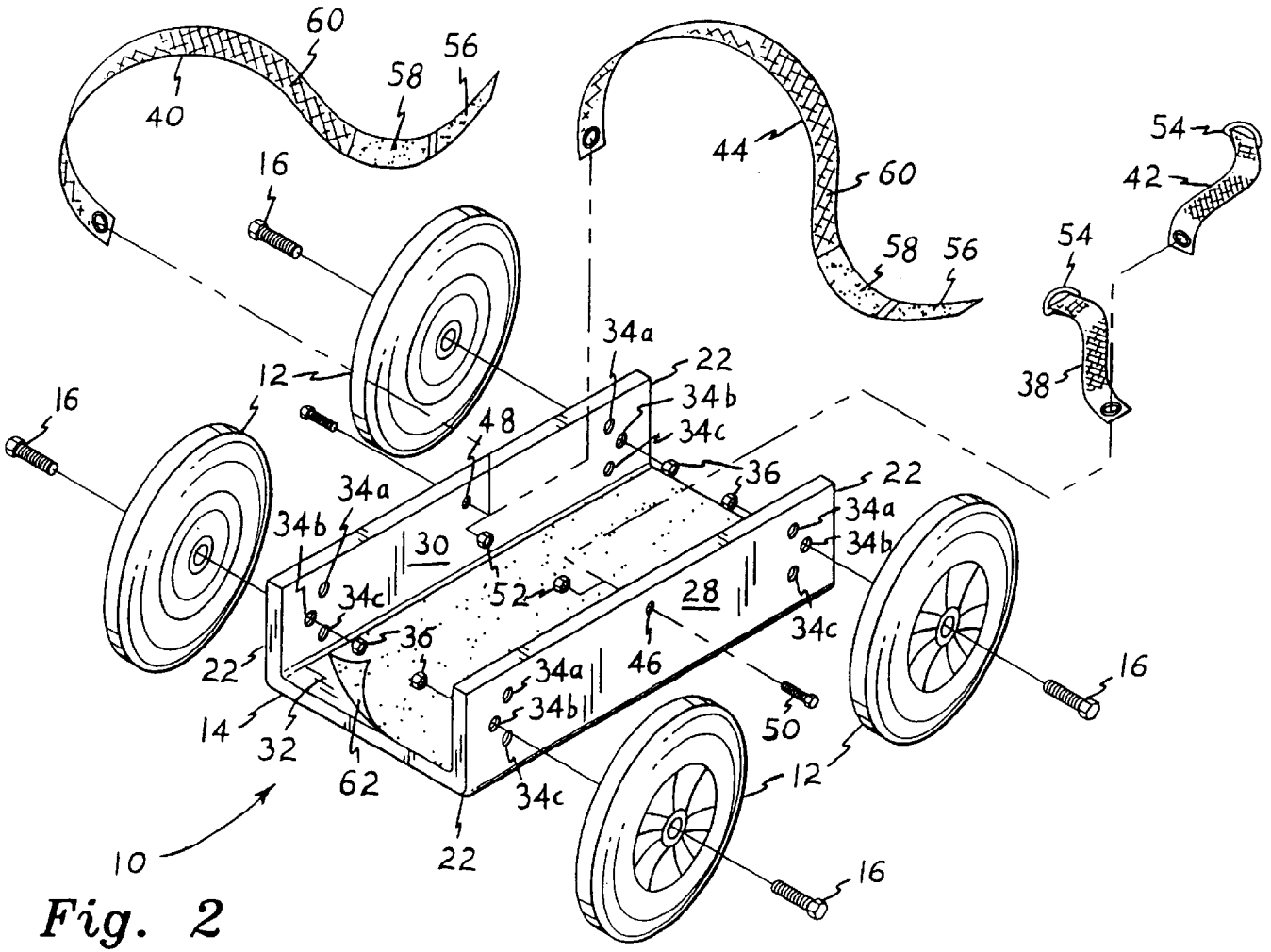
FIG. 2 is an exploded perspective view of a single roller skate according to the present invention, showing further details thereof.

FIG. 2 provides an exploded perspective view of the skate embodiment illustrated in FIG. 1, and serves to illustrate structural details providing the features noted above. The skate frame 14 comprises a laterally and longitudinally symmetrical channel having a relatively short length 18 to allow the heel H and toe T of the skater's shoe S to extend therebeyond. This allows the skater to tip his or her shoe S forwardly or rearwardly to drag either the toe T or the heel H on the underlying surface for accelerating, braking, or maneuvering as desired. As the present skate 10 places the skater's shoe S very close to the underlying surface, the tipping of the foot forwardly or rearwardly to place the toe T or heel H in contact with the surface, is easily accomplished and requires only a slight angular deflection of the foot and shoe S. The width 20 of the frame 14 is sufficient to cradle the skater's shoe S therein, generally as shown in FIG. 1.

The frame 14 has a rectangular platform, as shown clearly in FIG. 2 of the drawings. This rectangular form defines four corners 22 for the frame 14, with one of the wheel axle 16 being immovably affixed (i.e., bolted in place so that they cannot move during operation of the skate 10) generally at each respective corner 22 to extend laterally therefrom. The four wheel axles 16 are embodied as four axle bolts preferably secured to the frame 14 at the same level relative to one another, to define an axle plane 24 (shown in the embodiment of FIG. 3) through the frame (frame 114, in FIG. 3). Provision may be made to reposition the axle bolts vertically in the frame, but they are still considered to be immovable during skate operation.

The four wheels 12 have relatively large diameters, and are all equal in diameter to one another. The wheels 12 may be the same as those used on two wheeled scooters of various sorts (e.g., Razor™; scooter, etc.), or similar wheels providing the required size and durability. The relatively large diameters of the wheels 12, along with the axis attachment adjacent the ends or corners 22 of the frame 14, results in the radii of the wheels 12 extending forwardly and rearwardly beyond the length 18 of the frame 14, as shown clearly in FIG. 1 of the drawings. This provides a relatively long wheelbase for the skate 10, providing exceptional longitudinal stability for the skate 10. Laterally opposed pairs of wheels 12 define a lateral span 26 thereacross which extends beyond the width 20 of the frame 14, as shown in FIG. 1. This provides a relatively wide track for the present skate 10, for exceptional lateral stability for the skate 10.

FIG. 2 provides a clear view of the frame 14 of the present skate 10, illustrating its features. The frame 14 is preferably formed as a unitary structure of extruded aluminum channel having relatively thick walls (e.g., ¼ inch or so) for good durability and strength. The frame 14 has a generally rectangular cross section (excepting the open top), with opposed first and second side walls, respectively 28 and 30, extending upwardly from the edges of a sole plate or floor 32 which extends laterally between the lower edges of the two side walls 28 and 30 and is formed integrally therewith.

In other words, the skate 10 comprises the frame 14 having the sole plate 32 for supporting a foot of the skater thereon and at least two side walls 28, 30 extended from two outer sides of the sole plate 32, wherein at least two wheels 12 are rotatably attached to the two side walls 28, 30 respectively. As shown in FIG. 2, the two side walls 28, 30 are integrally and upwardly extended from the sole plate 32 to form the frame 14 having a U-shaped cross section such that the foot of the skater is able to cradle on the slot plate 32 and position between the two side walls 28, 30.

Figure 3:
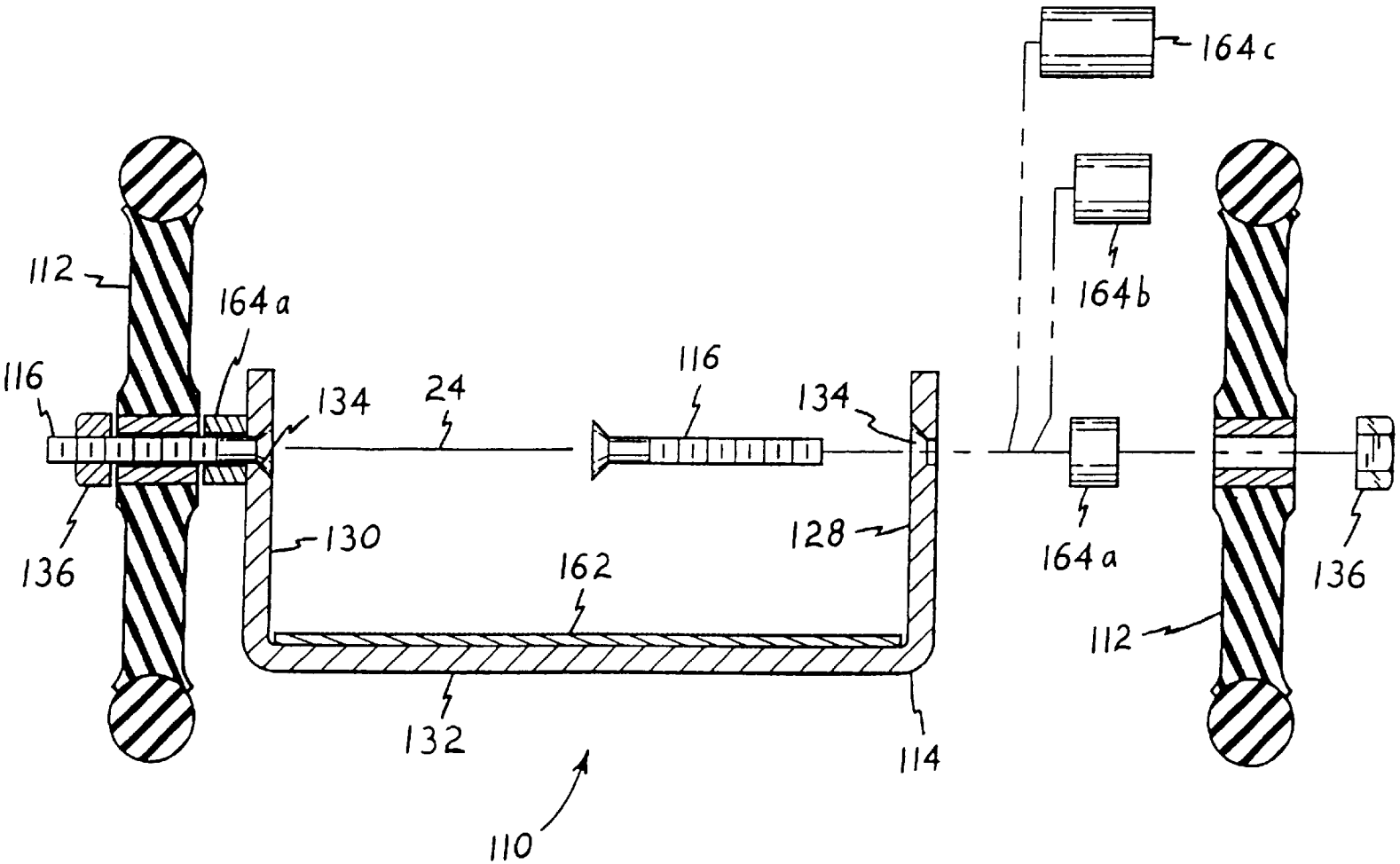
FIG. 3 is an end elevation view in section of an alternate embodiment roller skate according to the present invention, showing various details thereof.

The four axle bolts 16 are inserted into corresponding threaded holes, e.g., holes 34*a*, 34*b*, or 34*c*, formed through the vertical side walls 28 and 30 above the sole plate 32, thereby positioning the sole plate well below the axle plane 24. FIG. 3 illustrates this relationship, with the sole plate being designated as component 132 of the frame 114. The positioning of the axle bolts 16 well above the sole plate 32 (or 132, in the skate 100 of FIG. 3), results in the radii of the wheels 12 extending only slightly below the bottom of the sole plate 32 or 132, thus placing the sole plate 32 or 132 immediately adjacent the underlying surface and providing the desired very low center of gravity and resulting excellent stability for the skate 10 or 100.

Therefore, the center of each wheel 12 is positioned below the sole plate 32 so as to lower the ground distance of the slot plate 32. Even a lager radius of the wheel 12 is used for the present skate 10, the skate 10 is capable of providing an excellent stability for the skater comparing with the conventional roller skate.

The three different axle bolt holes 34*a*, 34*b*, and 34*c* at the frame corners 22, provide vertical adjustability for the axle bolts 16 and thus the wheels 12 of the skate 10. While three such threaded bolt holes 34*a* through 34*c* are shown at each corner 22, it will be understood that a single bolt hole may be provided if no vertical adjustability is desired, or two or more holes may be provided for vertical adjustment. The three holes 34*a* through 34*c* may be diagonally offset from one another as shown in FIG. 2, to provide greater edge distance between adjacent holes. Thus, the height of the axles 16 above the sole plate 32 is easily adjusted to adjust the proximity of the sole plate to the underlying surface, by selectively securing the axle bolts 16 in any of the holes 34*a* through 34*c* as desired. Also, a series of longitudinally spaced holes may be used to move wheels closer together so as a sharper turning radius could be achieved. Lock nuts 36 may be used to fix the axle bolts 16 immovably in their respective bolt holes.

The present skate 10 is secured about the skater's foot and shoe S by cooperating an ankle securing unit for securely holding the foot of the skater on the sole plate 32, wherein the ankle securing unit comprises first and second instep straps, respectively 38 and 40 for substantially holding an instep of the skater's foot, and first and second heel straps, respectively 42 and 44 for substantially holding a heel of the skater's foot.

The two first instep and heel straps 38 and 42 are secured to and extend from a first common strap attachment hole 46 formed through the first side wall 28 of the frame 14, with the two second instep and heel straps 40 and 44 secured to and extending from a second common strap attachment hole 48 formed in the second side wall 30. The two holes 46 and 48 are positioned laterally across from one another, and are preferably medially disposed along the lengths of their respective side walls 28 and 30 to provide for the desired longitudinal symmetry of the present skate 10. Strap attachment bolts 50 and nuts 52 may be used to secure the respective strap ends to the side walls 28 and 30.

Each of the first straps 38 and 42 has a D-ring 54 extending from its distal end, with the two second instep and heel straps 40 and 44 each having mutually mating or adhering first and second portions 56 and 58 of hook and loop fastener material (e.g., Velcro®) disposed upon the attachment surface 60 thereof. Each second strap 40 and 44 is looped through the D-ring 54 of its respective first strap 38 and 40, and folded back over itself to secure the two mating fastener surfaces 56 and 58 to one another, thereby securing the instep strap assembly 38, 40 and the heel strap assembly 42, 44 respectively over the instep and heel of the skater's foot and shoe S. A non-skid coating 62 (roughened surface, rubberized sheet, etc.) may be applied to the sole plate 32, to provide a better grip for the skater's shoe S within the skate frame or channel 14.

Therefore, as shown in FIGS. 1 and 2, when the foot of the skater is cradled on the sole plate 32, the instep of the skater's foot is secured by attaching the first and second instep straps 38, 40 together to form an instep loop having a predetermined length and the first and second heel straps 40, 44 together to form a heel loop having a predetermined length. Besides, the ankle securing unit fits for securely holding any size of the foot of the skater by selectively adjusting the lengths of the instep loop and the heel loop respectively.

FIG. 3 illustrates an alternative embodiment of the present skate 10, designated as skate 110. Most components are identical to those of the skate 10 of FIGS. 1 and 2, with corresponding components generally designated by three digit reference numerals with corresponding second and third numbers, i.e., frame 14 for the embodiment of FIGS. 1 and 2 and frame 114 for FIG. 3, etc. The skate 110 of FIG. 3 differs from the skate 10 of FIG. 2 primarily in that the axle bolts 116 are flat head bolts, rather than having protruding heads as in the bolts 16 of the skate 10. The axle passages 134 are correspondingly countersunk from the inner sides of the two side walls 128 130, thus providing a smooth and flush inner surface for each of the side walls 128 and 130 to preclude marring of the skater's shoes therein. An additional liner (not shown) may be installed along the inner surfaces of the side walls 128 and 130, in the manner of the non-skid coating 162 if so desired, to provide further shoe protection.

While only a single axle hole or passage 134 is illustrated through each side wall 128 and 130 of the skate 110 of FIG. 3, additional hole (not shown) of different heights could be provided through the two side walls 128 and 130 if so desired, in the manner of the holes or passages 34*a*, 34*b*, and 34*c* of the skate 10 of FIGS. 1 and 2. Also, while only the axle passages 134 are illustrated through the side walls 128 and 130 in FIG. 3, it will be apparent that the strap attachment passages (not shown) may also be countersunk with flat head bolts passing through from the inside surfaces, in the manner of the axle bolts 116.

The skate 110 of FIG. 3 also provides for the lateral adjustment of spacing of the wheels 112 by means of a series of different length spacers or sleeves, e.g., 164*a*, 164*b*, and 164*c*, which may be interchangeably installed on the corresponding axle bolt 116 between each of the wheels 112 and its adjacent side wall 128 or 130. If a relatively narrow and compact lateral track width is desired, then the shorter spacers 164*a* may be installed on the axle bolts 116 between the wheels 112 and their corresponding side walls 128 and 130 of the frame 114. For an even narrower track, a relatively thin, conventional washer (not shown) may be used in place of the sleeves 164*a*.

In the event that greater lateral stability is desired, intermediate length sleeves 164*b* or longer sleeves 164*c* may be installed on the bolts 116, as desired. Various combinations of sleeves 164*a* through 164*c*, and/or washers, may be used to adjust the spacing as desired, with the maximum lateral spacing of the wheels 112 being dependent only upon the length of the bolts 116 and the need to avoid contact between the two facing components of each skate 110 of a pair of skates while skating. The assembly is held in place by lock nuts 136 or equivalent, secured to the outer ends of the axle bolts 116. It will be noted that FIG. 3 is somewhat simplified, in that details of wheel bearings, seals, etc. are not shown, in order to provide clarity in the drawing Figure and to clearly illustrate the novel and inventive features of the present skate. However, such components are conventional, and may be provided during manufacture and/or assembly of the present skate.

Figure 4:
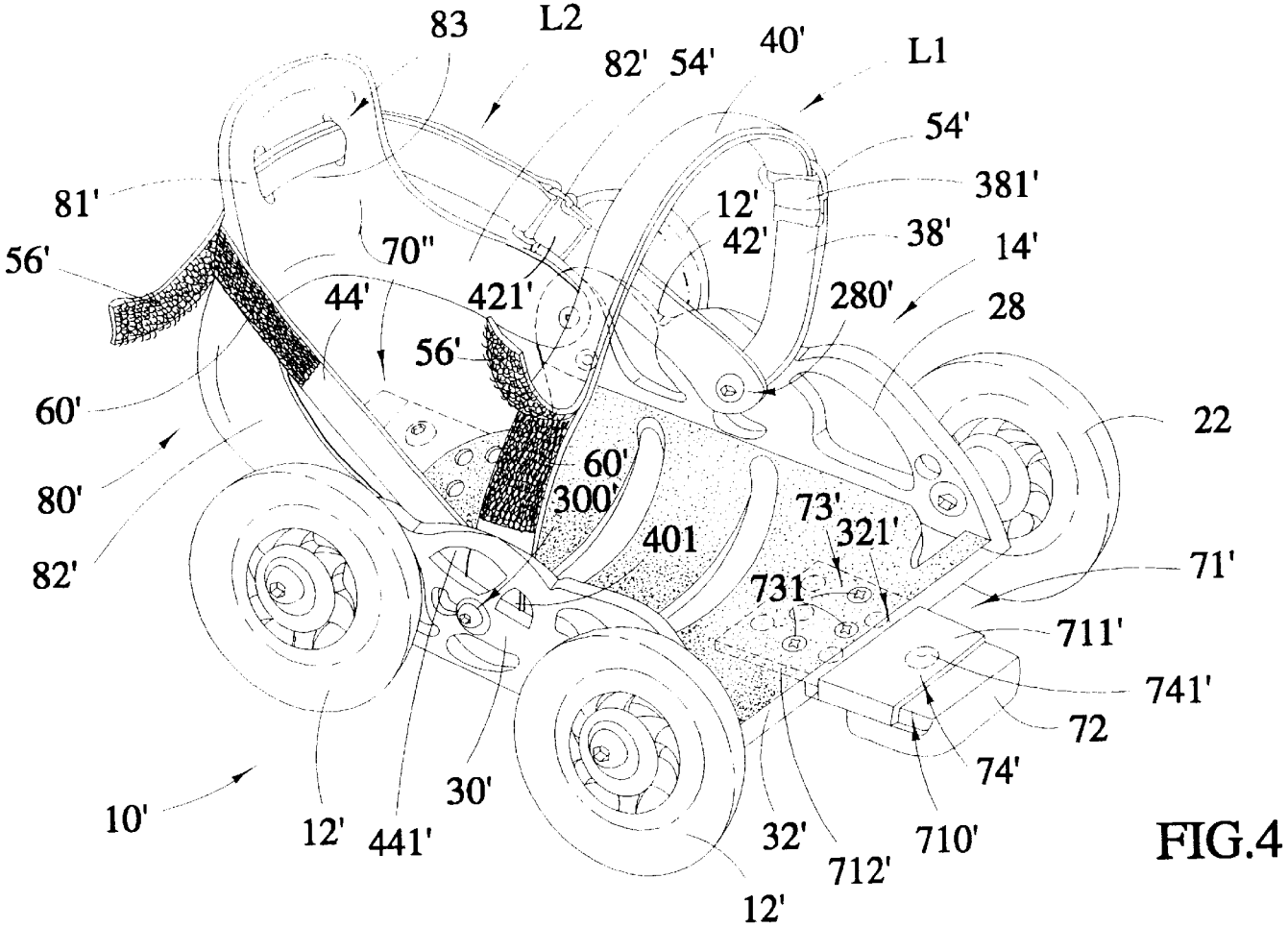
FIG. 4 illustrates an alternative mode of an ankle securing unit of the roller skate according to the present invention.
Figure 5:
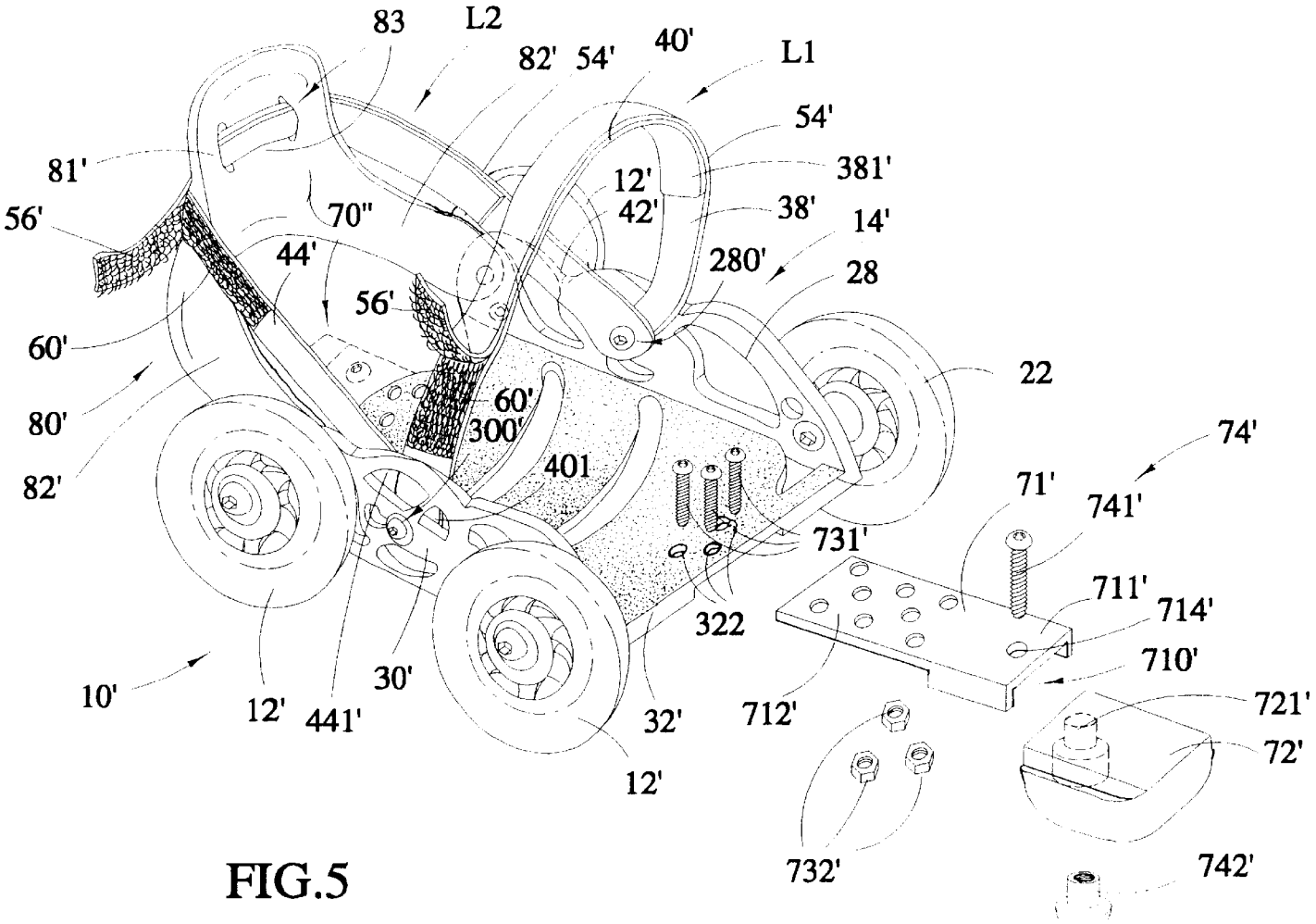
FIG. 5 is an exploded perspective view of a brake device of the roller skate according to the present invention.

FIGS. 4 and 5 illustrates another alternative embodiment of the present skate 10, designated as skate 10'. Most components are identical to those of the skate 10 of FIGS. 1 and 2, with corresponding components generally adding an apostrophe to reference numerals as shown in FIGS. 1 and 2, i.e., frame 14 for the embodiment of FIGS. 1 and 2 and frame 14' for FIGS. 4 and 5, etc. The skate 10' of FIGS. 4 and 5 differs from the skate 10 of FIG. 2 primarily in further illustrating the roller skate having a ornamentally modified frame 14' which is capable of incorporating with a brake device 70' and/or an ankle support 80'.

Referring to FIGS. 4 and 5, the frame 14' is illustrated as providing two transversal slots 141', 142' on the sole plate 32' and decorative through holes 143' on the two side walls 28', 30'. The brake device 70' comprises a brake arm 71' having a front brake end 711' extended outwardly from a first side of the sole plate 32' in a suspended manner and a braking element 72' replaceably affixed to a front brake end 711 ' of the brake arm 71' for frictionally biasing against the ground so as to allow the skater to stop or reduce the speed of the skate 10'. According to the preferred embodiment, a mounting groove 321' is formed perpendicularly on a bottom surface of the first side (i.e. the front side) of the sole plate 32'.

The brake device 70' further comprises a securing means 73' for affixing the brake arm 71', which is made of rigid material such as steel, aluminum alloy or ABS plastic, underneath the first side of the sole plate 32'. According to the embodiment, a connection end 712' of the mounting groove 321' is received in the mounting groove 321' of the sole plate 32' and the securing means comprises at least a securing bolt 731' and a securing nut 732' screwed to a threaded end of the securing bolt 731' that passes through a respective secure hole 322', which is provided on the first side of sole plate 32' and right above the mounting groove 321', and a respective arm hole 713' of a plurality of arm holes 713' provided on the connecting end 712' of the brake arm 71', as shown in FIG. 4.

The brake device 70' further comprises an affixing means 74' for affixing the brake element 72' to the brake end 711' of the brake arm 71'. According to the embodiment, the affixing means 74' comprises a fastening bolt 741', which penetrates through a fastening hole 714' provided on the brake end 711' of the brake arm 71' and a lock hole 721' provided on the brake element 72, and a fastening nut head 742' screwed to a bottom threaded end of the fastening bolt 741' so as to fasten the brake element 72' to the brake arm 71'.

It is worth to indicate that the brake end 711 ' of the brake arm 71' is preferred to have a U-shaped cross section so as to define a brake groove 710' underneath in such a manner that the brake element 72' is fittingly received therein so as to guide and block any sideward movement of the brake element 72'. The brake element 72 is made of rubber or other material that is capable of providing a frictional force with respect to the ground. Also, an enlarged nut head receiving groove 722' can be formed at a bottom end of the lock hole 721' so that the entire fastening nut head 742' can be received therein.

Accordingly. the brake element 72' can be replaced when the brake element 72' is worn off for a period of continued use. It is worth to mention that the brake arm 71' can be detached from the front side of the sole plate 32' and attached to the rear side of the sole plate 32' such that the brake element 72' is suspended at the rear side of the skate 10'.

Besides, the skater is able to adjust the position of the attachment between the sole plate 32' and the brake arm 71' by attaching with different arm holes 731' of the brake arm 71' with respect to the sole plate 32', so as to a length of the brake arm 71' outwardly protruded from the sole plate 32'. Therefore, the skater is able to selectively install the brake device 70' at the front or the rear side of the sole plate 32' or both the front and rear sides of the sole plate 32 with two brake devices 70', 70" respectively.

The ankle support 80', as shown in FIG. 4, comprises a curved back support 81' upwardly extended for fitting against a lower portion of the skater's shank and two mounting wings 82' frontwardly extended from two sides of a lower end of the back support 81' to pivotally secure to two rear portions of the two side walls 28', 30', so as to support the ankle support 80' at a rear end of the roller skate of the present invention. By selecting different connecting positions at the side walls 28', 30' to secure the two mounting wings 82' and adjusting the ankle support 80' to turn upwardly or downwardly with respect to the sole plate 32', the skater can substantially fit the ankle support 80' to support against the skater's shank so as to provide a firm support between the skater's foot and shank.

A pair of securing slots 83' are spacedly formed at an upper portion of the back support 81 ' of the ankle support 80', as shown in FIG. 4, so that by penetrating the heel strap 44' through the securing slots 83', the ankle support 80' can be secured with the skater's shank while wearing the roller skate to the skater's foot by means of the connection of the heel strap 44' and the instep strap 42', so that the ankle support 80' can hold the heel of the skater's foot in position. Moreover, the back support 81 ' is preferred to have a curved inner surface for fitting the shape of the lower portion of the shank of the skater.

Therefore, when tightening the ankle securing unit to the ankle of the skater, the ankle support 80' can be supported and held in position to back up the skater's ankle. As shown in FIG. 4, the ankle securing unit also comprises first and second instep straps 38', 42' and first and second heel straps 42', 44'. Each of the first instep strap 38' and the first heel strap 42' has a first connecting end 381', 421' extended to a position 280' between the front wheel 12' and the rear wheel 12' on the first side wall 28' and the two first connecting ends 381', **42*a'* of the first instep strap 38' and the first heel strap 42' are jointly secured to the first side wall 38'. Each of the second instep strap 40' and the second heel strap 44' has a second connecting end 401', 441' extended to a position 300' between the front wheel 12' and the rear wheel 12' on the second side wall 30' and the two second connecting ends 401', 441' of the second instep strap 40' and the second heel strap 44' are jointly secured to the second side wall 30'**.

Moreover, the first instep strap 38' and the second instep strap 40' are detachably connected together by means of the loop and hook fasteners 56', 60' to form an instep loop L1 having a predetermined length for extending over an instep of the foot of the skater and tightening around a front portion of the ankle of the skater. Similarly, the first heel strap 42' and the second heel strap 44' are detachably connected together by means of the loop and hook fasteners 56', 60' to form an heel loop L2 having a predetermined length for extending and tightening around a back portion of the ankle of the skater, so as to substantially securely hold the foot of the skater on the sole plate 32' by tightening around the ankle of the foot of the skater with the ankle securing unit.

Alternatively, as shown in FIG. 5, the ankle securing unit is embodied to include a pair of loop and hook fasteners adapted detachably connecting the first and second instep straps together and the first and second heel straps together respectively, wherein each of the pairs of loop and hook fasteners comprises a loop fastener and a hook fastener. The two hook fasteners are extended and attached on upper surfaces of the second instep and heel straps respectively and the two loop fasteners are extended and attached on bottom surfaces of the first instep and heel straps respectively. The first instep strap is able to be connected with the second instep strap by fastening the loop fastener of the first instep strap and the hook fastener of the second instep strap. The first heel strap is able to be connected with the second heel strap by fastening the loop fastener of the first heel strap and the hook fastener of the second heel strap.

In conclusion, the present roller skate in its various embodiment provides a novel construction which in turn provides many advantages in terms of safety and stability over skates of the related art. The placement of the sole plate or floor of the skate body or frame very close to the underlying surface when the skates are in use, provides superior stability in comparison to earlier skates having their wheels disposed beneath the sole plate. While relatively low sole plates have been developed in the past, as exemplified by the related art of record, none of those skates provided four widely spaced wheels at the corners of the skate frame and, at the same time, lowered the gravity of the roller skate by reducing the distance between the sole plate 32, 132 and the skating ground so as to provide the stability of the present roller skate.

The vertical adjustability of the wheels of the present skate provides further advantages, in that the height of the sole plate may be raised relative to the underlying surface by moving the axle bolts to higher bolt holes or passages in the side walls of the skate frame. While this sacrifices some stability, it allows use of the present skate over relatively rough and/or uneven surfaces, where the bottom of the sole plate might otherwise drag upon various protruding irregularities extending from the underlying surface. The present skate allows the height to be adjusted as low as possible for smooth surfaces, while still allowing the skate to be used on relatively rough and uneven surfaces as well, which operation is facilitated by the relatively large wheels of the present skate.

Moreover, the lateral adjustability provided by the present skate construction provides further benefits, particularly on rough or uneven surfaces, or perhaps for the novice skater. The present skate has far greater lateral stability than earlier skates of the related art, again due to the low sole plate or floor of the frame, the widely laterally spaced wheels, the fact that four wheels are provided in a rectangular pattern at the corners of the frame, and the relatively large diameter of the wheels. Yet, an experienced skater, or a skater skating on a smooth surface, may wish to narrow the track of the skate, which adjustment is easily accomplished by means of the replaceable sleeves discussed further above.

Yet another advantage of the present skate is its lateral and longitudinal symmetry, as there is no such thing as a "left" and a "right" skate with the present roller skate. Each skate provided for each foot is identical to the other, with perhaps the only difference being the installation of the first and second attachment straps. Even this difference is easily changed by the user to position either the first or the second straps to extend from either the first or second attachment holes to place the first strap D ring and folded second strap to the inside or outside of the shoe, as desired. Thus, the present skate will be seen to provide much needed advances in safety and utility in comparison to earlier skates, and will find widespread popularity among skaters.

It is to be understood that the present invention is not limited to the embodiments described above, but encompasses any and all embodiments within the scope of the following claims.

What is claimed is:

1. A roller skate, comprising:

a frame including a sole plate for supporting a foot of a skater thereon and at least two side walls upwardly extended from two longitudinal sides of said sole plate;

two pairs of front and rear wheels rotatably attached to two outer sides of said two side walls respectively; and an ankle securing unit, adapted for securely holding the foot of the skater on said sole plate, comprising first and second instep straps and first and second heel straps, wherein each of said first instep strap and said first heel strap has a first connecting end extended to a position between said front wheel and said rear wheel on said first side wall and said two first connecting ends of said first instep strap and said first heel strap are jointly secured to said first side wall, wherein each of said second instep strap and said second heel strap has a second connecting end extended to a position between said front wheel and said rear wheel on said second side wall and said two second connecting ends of said second instep strap and said second heel strap are jointly secured to said second side wall, wherein said first instep strap and said second instep strap are detachably connected together to form an instep loop having a predetermined length for extending over an instep of the foot of the skater and tightening around a front portion of the ankle of the skater, and that said first heel strap and said second heel strap are detachably connected together to form an heel loop having a predetermined length for extending and tightening around a back portion of the ankle of the skater, so as to substantially securely hold the foot of the skater on said sole plate by tightening around the ankle of the foot of the skater with the ankle securing unit.

2. The roller skate, as recited in claim 1, further comprising means for securing said two first connecting ends of said two first instep and heel straps at a first common strap attachment hole formed through said first side wall between said front and rear wheels, and means for securing said two second connecting ends of said two second instep and heel straps at a second common strap attachment hole formed in said second side wall, wherein said common first and second strap attachment holes are positioned opposing with each other.

3. The roller skate, as recited in claim 1, wherein said ankle securing unit further comprises a pair of D-rings affixed to two distal ends of said first instep and heel straps respectively and a pair of loop and hook fasteners attached to two attachment surfaces of said second instep and heel straps respectively, wherein each of said pairs of loop and hook fasteners comprises a loop fastener and a hook fastener and said two loop fasteners are attached to inner sections said two attachment surfaces of said second instep and heel straps respectively while said two hook fasteners are attached to outer sections of said attachment surfaces of said second instep and heel straps, wherein in order to form said instep and heel loops, said second instep and heel straps are penetrated through said two D-rings of said first instep and heel straps respectively and looped back until said two outer sections are overlapped with said inner sections of said attachment surfaces respectively to fasten said two hook fasteners with said two loop fasteners together so as to connect said second instep and heel straps with said first instep and heel straps.

4. The roller skate, as recited in claim 2, wherein said ankle securing unit further comprises a pair of D-rings affixed to two distal ends of said first instep and heel straps respectively and a pair of loop and hook fasteners attached to two attachment surfaces of said second instep and heel straps respectively, wherein each of said pairs of loop and hook fasteners comprises a loop fastener and a hook fastener and said two loop fasteners are attached to inner sections said two attachment surfaces of said second instep and heel straps respectively while said two hook fasteners are attached to outer sections of said attachment surfaces of said second instep and heel straps, wherein in order to form said instep and heel loops, said second instep and heel straps are penetrated through said two D-rings of said first instep and heel straps respectively and looped back until said two outer sections are overlapped with said inner sections of said attachment surfaces respectively to fasten said two hook fasteners with said two loop fasteners together so as to connect said second instep and heel straps with said first instep and heel straps.

5. The roller skate, as recited in claim 1, wherein said ankle securing unit further comprises a pair of loop and hook fasteners adapted detachably connecting said first and second instep straps together and said first and second heel straps together respectively, wherein each of said pairs of loop and hook fasteners comprises a loop fastener and a hook fastener, wherein said two loop fasteners are extended and attached on upper surfaces of said second instep and heel straps respectively and said two hook fasteners are extended and attached on bottom surfaces of said first instep and heel straps respectively, wherein said first instep strap is able to be connected with said second instep strap by fastening said hook fastener of said first instep strap and said loop fastener of said second instep strap, and that said first heel strap is able to be connected with said second heel strap by fastening said hook fastener of said first heel strap and said loop fastener of said second heel strap.

6. The roller skate, as recited in claim 2, wherein said ankle securing unit further comprises a pair of loop and hook fasteners adapted detachably connecting said first and second instep straps together and said first and second heel straps together respectively, wherein each of said pairs of loop and hook fasteners comprises a loop fastener and a hook fastener, wherein said two loop fasteners are extended and attached on upper surfaces of said second instep and heel straps respectively and said two hook fasteners are extended and attached on bottom surfaces of said first instep and heel straps respectively, wherein said first instep strap is able to be connected with said second instep strap by fastening said hook fastener of said first instep strap and said loop fastener of said second instep strap, and that said first heel strap is able to be connected with said second heel strap by fastening said hook fastener of said first heel strap and said loop fastener of said second heel strap.

7. The roller skate, as recited in claim 1, wherein said ankle securing unit further comprises a pair of loop and hook fasteners adapted detachably connecting said first and second instep straps together and said first and second heel straps together respectively, wherein each of said pairs of loop and hook fasteners comprises a loop fastener and a hook fastener, wherein said two hook fasteners are extended and attached on upper surfaces of said second instep and heel straps respectively and said two loop fasteners are extended and attached on bottom surfaces of said first instep and heel straps respectively, wherein said first instep strap is able to be connected with said second instep strap by fastening said loop fastener of said first instep strap and said hook fastener of said second instep strap, and that said first heel strap is able to be connected with said second heel strap by fastening said loop fastener of said first heel strap and said hook fastener of said second heel strap.

8. The roller skate, as recited in claim 2, wherein said ankle securing unit further comprises a pair of loop and hook fasteners adapted detachably connecting said first and second instep straps together and said first and second heel straps together respectively, wherein each of said pairs of loop and hook fasteners comprises a loop fastener and a hook fastener, wherein said two hook fasteners are extended and attached on upper surfaces of said second instep and heel straps respectively and said two loop fasteners are extended and attached on bottom surfaces of said first instep and heel straps respectively, wherein said first instep strap is able to be connected with said second instep strap by fastening said loop fastener of said first instep strap and said hook fastener of said second instep strap, and that said first heel strap is able to be connected with said second heel strap by fastening said loop fastener of said first heel strap and said hook fastener of said second heel strap.

9. The roller skate, as recited in claim 1, further comprising a brake device which comprises an brake arm outwardly extended from a first side of said sole plate and a brake element replaceably attached to a free end of said brake arm for frictionally biasing a skating ground for reducing a speed of said roller skate.

10. The roller skate, as recited in claim 2, further comprising a brake device which comprises an brake arm outwardly extended from a first side of said sole plate and a brake element replaceably attached to a free end of said brake arm for frictionally biasing a skating ground for reducing a speed of said roller skate.

11. The roller skate, as recited in claim 3, further comprising a brake device which comprises an brake arm outwardly extended from a first side of said sole plate and a brake element replaceably attached to a free end of said brake arm for frictionally biasing a skating ground for reducing a speed of said roller skate.

12. The roller skate, as recited in claim 4, further comprising a brake device which comprises an brake arm outwardly extended from a first side of said sole plate and a brake element replaceably attached to a free end of said brake arm for frictionally biasing a skating ground for reducing a speed of said roller skate.

13. The roller skate, as recited in claim 5, further comprising a brake device which comprises an brake arm outwardly extended from a first side of said sole plate and a brake element replaceably attached to a free end of said brake arm for frictionally biasing a skating ground for reducing a speed of said roller skate.

14. The roller skate, as recited in claim 6, further comprising a brake device which comprises an brake arm outwardly extended from a first side of said sole plate and a brake element replaceably attached to a free end of said brake arm for frictionally biasing a skating ground for reducing a speed of said roller skate.

15. The roller skate, as recited in claim 1, further comprising an ankle support, adapted for supporting said ankle of said skater with respect to said sole plate, comprising a back support upwardly extended for fitting against a lower portion of a shank of the skater and two mounting wings frontwardly extended from two sides of a lower end of said back support to secure to two rear portions of said two side walls, so as to support said ankle support at a rear end of said roller skate.

16. The roller skate, as recited in claim 15, wherein at least a securing slot is spacedly formed at an upper portion of said back support of said ankle support, wherein at least one of said first and second heel straps is arranged to penetrate through said securing slots so as to connect said ankle support with said first and second heel straps for ensuring said ankle support to support the shank of the skater when said first and second heel straps are connected together to form said heel loop.

17. The roller skate, as recited in claim 2, further comprising an ankle support, adapted for supporting said ankle of said skater with respect to said sole plate, comprising a back support upwardly extended for fitting against a lower portion of a shank of the skater and two mounting wings frontwardly extended from two sides of a lower end of said back support to secure to two rear portions of said two side walls, so as to support said ankle support at a rear end of said roller skate.

18. The roller skate, as recited in claim 17, wherein at least a securing slot is spacedly formed at an upper portion of said back support of said ankle support, wherein at least one of said first and second heel straps is arranged to penetrate through said securing slots so as to connect said ankle support with said first and second heel straps for ensuring said ankle support to support the shank of the skater when said first and second heel straps are connected together to form said heel loop.

19. The roller skate, as recited in claim 4, further comprising an ankle support, adapted for supporting said ankle of said skater with respect to said sole plate, comprising a back support upwardly extended for fitting against a lower portion of a shank of the skater and two mounting wings frontwardly extended from two sides of a lower end of said back support to secure to two rear portions of said two side walls, so as to support said ankle support at a rear end of said roller skate.

20. The roller skate, as recited in claim 19, wherein at least a securing slot is spacedly formed at an upper portion of said back support of said ankle support, wherein at least one of said first and second heel straps is arranged to penetrate through said securing slots so as to connect said ankle support with said first and second heel straps for ensuring said ankle support to support the shank of the skater when said first and second heel straps are connected together to form said heel loop.

21. The roller skate, as recited in claim 6, further comprising an ankle support, adapted for supporting said ankle of said skater with respect to said sole plate, comprising a back support upwardly extended for fitting against a lower portion of a shank of the skater and two mounting wings frontwardly extended from two sides of a lower end of said back support to secure to two rear portions of said two side walls, so as to support said ankle support at a rear end of said roller skate.

22. The roller skate, as recited in claim 21, wherein at least a securing slot is spacedly formed at an upper portion of said back support of said ankle support, wherein at least one of said first and second heel straps is arranged to penetrate through said securing slots so as to connect said ankle support with said first and second heel straps for ensuring said ankle support to support the shank of the skater when said first and second heel straps are connected together to form said heel loop.

23. The roller skate, as recited in claim 1, further comprising an ankle support, adapted for supporting said ankle of said skater with respect to said sole plate, comprising a back support upwardly extended for fitting against a lower portion of a shank of the skater and two mounting wings frontwardly extended from two sides of a lower end of said back support to secure to two rear portions of said two side walls, so as to support said ankle support at a rear end of said roller skate.

24. The roller skate, as recited in claim 15, wherein at least a securing slot is spacedly formed at an upper portion of said back support of said ankle support, wherein at least one of said first and second heel straps is arranged to penetrate through said securing slots so as to connect said ankle support with said first and second heel straps for ensuring said ankle support to support the shank of the skater when said first and second heel straps are connected together to form said heel loop.

25. The roller skate, as recited in claim 9, further comprising an ankle support, adapted for supporting said ankle of said skater with respect to said sole plate, comprising a back support upwardly extended for fitting against a lower portion of a shank of the skater and two mounting wings frontwardly extended from two sides of a lower end of said back support to secure to two rear portions of said two side walls, so as to support said ankle support at a rear end of said roller skate.

26. The roller skate, as recited in claim 1, wherein at least a securing slot is spacedly formed at an upper portion of said a support of said ankle support, wherein at least one of said first and second heel straps is arranged to penetrate through said securing slots so as to connect said ankle support with said first and second heel straps for ensuring said ankle support to support the shank of the skater when said first and second heel straps are connected together to form said heel loop.

27. The roller skate, as recited in claim 10, further comprising an ankle support, adapted for supporting said ankle of said skater with respect to said sole plate, comprising a back support upwardly extended for fitting against a lower portion of a shank of the skater and two mounting wings frontwardly extended from two sides of a lower end of said back support to secure to two rear portions of said two side walls, so as to support said ankle support at a rear end of said roller skate.

28. The roller skate, as recited in claim 26, wherein at least a securing slot is spacedly formed at an upper portion of said back support of said ankle support, wherein at least one of said first and second heel straps is arranged to penetrate through said securing slots so as to connect said ankle support with said first and second heel straps for ensuring said ankle support to support the shank of the skater when said first and second heel straps are connected together to form said heel loop.

29. The roller skate, as recited in claim 12, further comprising an ankle support, adapted for supporting said ankle of said skater with respect to said sole plate, comprising a back support upwardly extended for fitting against a lower portion of a shank of the skater and two mounting wings frontwardly extended from two sides of a lower end of said back support to secure to two rear portions of said two side walls, so as to support said ankle support at a rear end of said roller skate.

30. The roller skate, as recited in claim 29, wherein at least a securing slot is spacedly formed at an upper portion of said back support of said ankle support, wherein at least one of said first and second heel straps is arranged to penetrate through said securing slots so as to connect said ankle support with said first and second heel straps for ensuring said ankle support to support the shank of the skater when said first and second heel straps are connected together to form said heel loop.

31. The roller skate, as recited in claim 14, further comprising an ankle support, adapted for supporting said ankle of said skater with respect to said sole plate, comprising a back support upwardly extended for fitting against a lower portion of a shank of the skater and two mounting wings frontwardly extended from two sides of a lower end of said back support to secure to two rear portions of said two side walls, so as to support said ankle support at a rear end of said roller skate.

32. The roller skate, as recited in claim 31, wherein at least a securing slot is spacedly formed at an upper portion of said back support of said ankle support, wherein at least one of said first and second heel straps is arranged to penetrate through said securing slots so as to connect said ankle support with said first and second heel straps for ensuring said ankle support to support the shank of the skater when said first and second heel straps are connected together to form said heel loop.

* * * * *